United States Patent [19]

Groves

[11] 4,061,070

[45] Dec. 6, 1977

[54] CANT STRIP MACHINE

[76] Inventor: John L. Groves, 5260 N. Genessee Road, Flint, Mich. 48506

[21] Appl. No.: 656,889

[22] Filed: Feb. 10, 1976

[51] Int. Cl.[2] ..... B27B 5/04; B27M 3/02

[52] U.S. Cl. ..... 83/404.4; 83/425.4; 83/436; 144/312; 144/136 R

[58] Field of Search ..... 83/404, 404.4, 407, 83/425, 425.1, 425.2, 425.3, 425.4, 436; 144/312, 136 R

[56] References Cited

U.S. PATENT DOCUMENTS

| | | | |
|---|---|---|---|
| 1,203,940 | 11/1916 | Trout | 83/425.4 |
| 1,582,027 | 4/1926 | Dunbar | 83/425.3 |
| 3,910,170 | 10/1975 | Boy | 144/136 R |
| 3,937,114 | 2/1976 | Joensson et al. | 144/312 |

*Primary Examiner*—Donald R. Schran
*Attorney, Agent, or Firm*—Clarence A. O'Brien; Harvey B. Jacobson

[57] ABSTRACT

A machine for sawing cant strips and the like for use in the industrial roofing trade. This machine has a strong rigidly constructed support table, feed rollers mounted on said support table for feeding the wood material to be sawed, a plurality of saw blades mounted on adjustable saw arbors in two banks, the saw blades of the first bank being at an angle of approximately 45 degrees with the table surface, and the angle of the saw blades of the second bank being at an angle of approximately 45° with the table surface, but with the plane of the saw blades of the second bank being approximately 90° to the plane of the saw blades of the first bank. Each of the saw arbors of each bank are adjustable so that the width of the material being cut may be varied. Two high powered drive motors are provided, one for each bank of saw blades. An additional reduced speed drive is provided for the feed rollers. Safety features such as a cover for the entire machine, side tension rollers and a guide fence, covers for the drive belts and chains, and magnetic off-on switches and heater switches are provided.

13 Claims, 4 Drawing Figures

13
14
16
20
28
119
302
407
118
300
120
119'
302'
12
220
225
226
224
222
221
407'
414
415

211
220
205
209
201
202
300
203
206
207
212
204

CANT STRIP MACHINE

BACKGROUND OF THE INVENTION

1. Field of the Invention

This invention relates generally to multiple sawing devices for use in the manufacturing of cant strips for the industrial roofing trade and the like.

2. Description of the Prior Art

A common problem with known prior art devices of this type are that the devices are relatively complicated to adjust, and fail to maintain a set adjustment after the initial adjustment thereafter.

Another common problem is that a number of the known devices using multiple saw blades have saw blades of different diameters to accomplish the end result. A great disadvantage of this type device is in the different rates of wear for the different diameter saw blades.

Known prior art patents which may be pertinent to this invention are as follows:

| | | |
|---|---|---|
| H. A. Current | 136,216 | Feb. 25, 1873 |
| G. Morgan et al | 149,327 | April 7, 1874 |
| J. T. Hall | 321,716 | July 7, 1885 |
| S. D. Riegal | 386,035 | July 10, 1888 |
| W. F. Barnes | 683,015 | Sept. 24, 1901 |
| M. P. Burrows | 1,818,300 | Aug. 11, 1931 |
| L. A. Holan | 3,625,269 | Dec. 7, 1971 |

None of these known prior art devices offer the new and unique features of the invention disclosed herein.

SUMMARY OF THE INVENTION

An object of the present invention is to provide a multiple sawing machine for producing cant strips for the industrial roofing trade. Two banks of multiple saw blades set at approximately 45° angles to the main support surface are utilized to effect this object.

Another object of the present invention is to provide a cant strip machine which will increase the amount of daily production of cant strips as compared to the number produced by conventional type sawing machines.

A further object of this invention is to provide a cant strip machine having adjustable saw assemblies of very narrow construction which allows the saw assemblies to be adjusted much closer together than would normally be expected for the purpose of creating a greater range of sizes and adjustments for the cant strips produced by said machine.

A still further object of this invention is to provide a cant strip machine having at least two banks of saws with the planes of the saw blades of each bank being set at an angle of approximately 90° to each other and approximately 45° respectively to the support table surface.

A still further object of this invention is to provide a cant strip machine employing two main drive assemblies together with adjustment features for said assemblies to permit a great range of adjustment and flexibility of operation of the device.

A still further object of the invention is to produce a cant strip sawing machine which is self-feeding and powered so as to make the ease of feeding material to the saw blade assemblies relatively effortless and simple for the machine operator.

An additional further object is to build a cant strip sawing machine which meets OSHA safety standards by employing cover guards for the entire top surface of the machine and approved guards for the belt and chain drives together with magnetic off-on switches and heater switches.

The cant strip sawing machine of this invention has many advantages over known conventional sawing machines. An important advantage of this machine is in the flexibility and adjustability of the over-all device. The machine of this device is capable of processing material of varying widths up to 36 inches and of varying thicknesses up to 2½inches simply by adjustment and re-adjustment of the saws and saw arbor assemblies.

Another important feature is that the machine is basically self-feeding. Material to be sawed is simply fed into the machine from a conveyor, or manually, and the machine then automatically feeds the material through the saws. Then the entire sawing sheet of material is picked up at the output end of the machine and placed on another conveyor where twin bundles of finished cant strip of approximately 100 linear feet each are stacked. These twin bundles then proceed along a conveyor line to an automatic banding machine where they are then banded and stacked onto pallets ready to be shipped to customers.

The machine of this invention produces cant strips for the industrial roofing trade of many different sizes. This machine accomplishes this in a very fast and expeditious manner. The machine basically will increase the production capacity over other machines using single and double saw blades by more than 1400%. With an increase of manpower of only one man an increase in daily production per 8-hour day has been accomplished from a previous maximum of 20,000 linear feet of finished material to over 200,000 linear feet.

The cant strip machine of this invention employs two banks of saws with each bank having the saw blades of said bank set at an approximately 45 ° angle to the vertical and with the planes of the banks respectively being approximately perpendicular to each other. Each saw blade of the respective banks are mounted on saw blade arbor support assemblies of narrow width which allows the saws to be adjusted quite close together. The saw assemblies are mounted on sliding ways to permit this simple and easy adjustment.

Heavy duty and heavy capacity motors are also employed to drive each bank of saw blades and increase the flexibility of the machine. Special v-type cog belts are employed between the drive motors and the saw blade arbors which run cooler and have less maintenace than conventional type belts. All the belts are adjustable for tension by adjusting screws on the bases of the saw assemblies.

The machine is self-feeding and has two corrugated feed rollers driven from a reduced speed drive means for transferring power to same.

The machine is built to OSHA standards and employes a complete cover for the entire machine to protect the operator thereof and also is equipped with chain and belt guards for the operator's protection. Magnetic off-and-on switches and heater switches are also employed.

These together with other objects and advantages which will become subsequently apparent reside in the details of construction and operation as more fully hereinafter described and claimed, reference being had to the accompanying drawings froming a part hereof, wherein like numerals refer to like parts throughout.

DESCRIPTION OF THE PREFERRED EMBODIMENT

Figure 1:
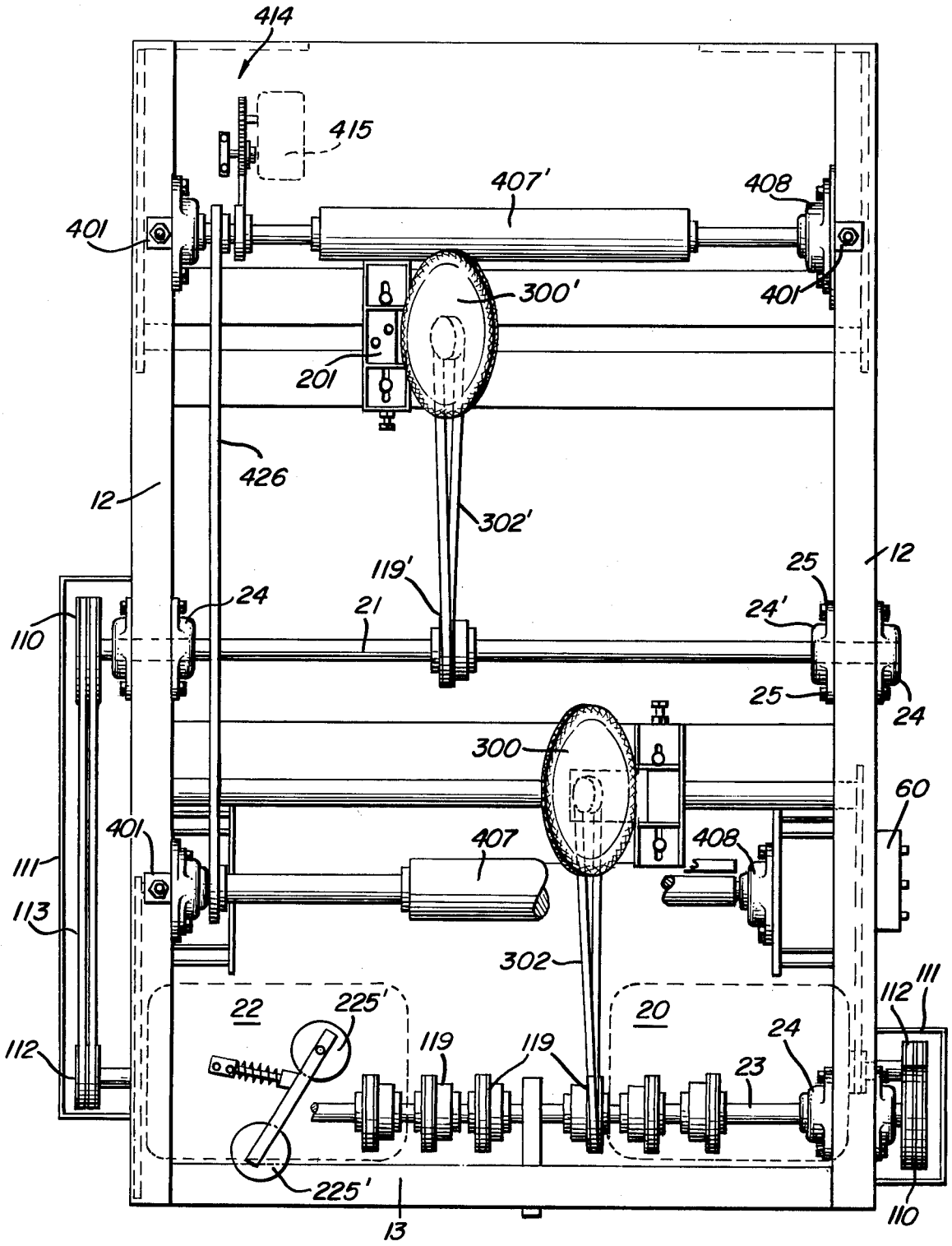
FIG. 1 is a top plan view of the cant strip sawing machine of this invention.
Figure 2:
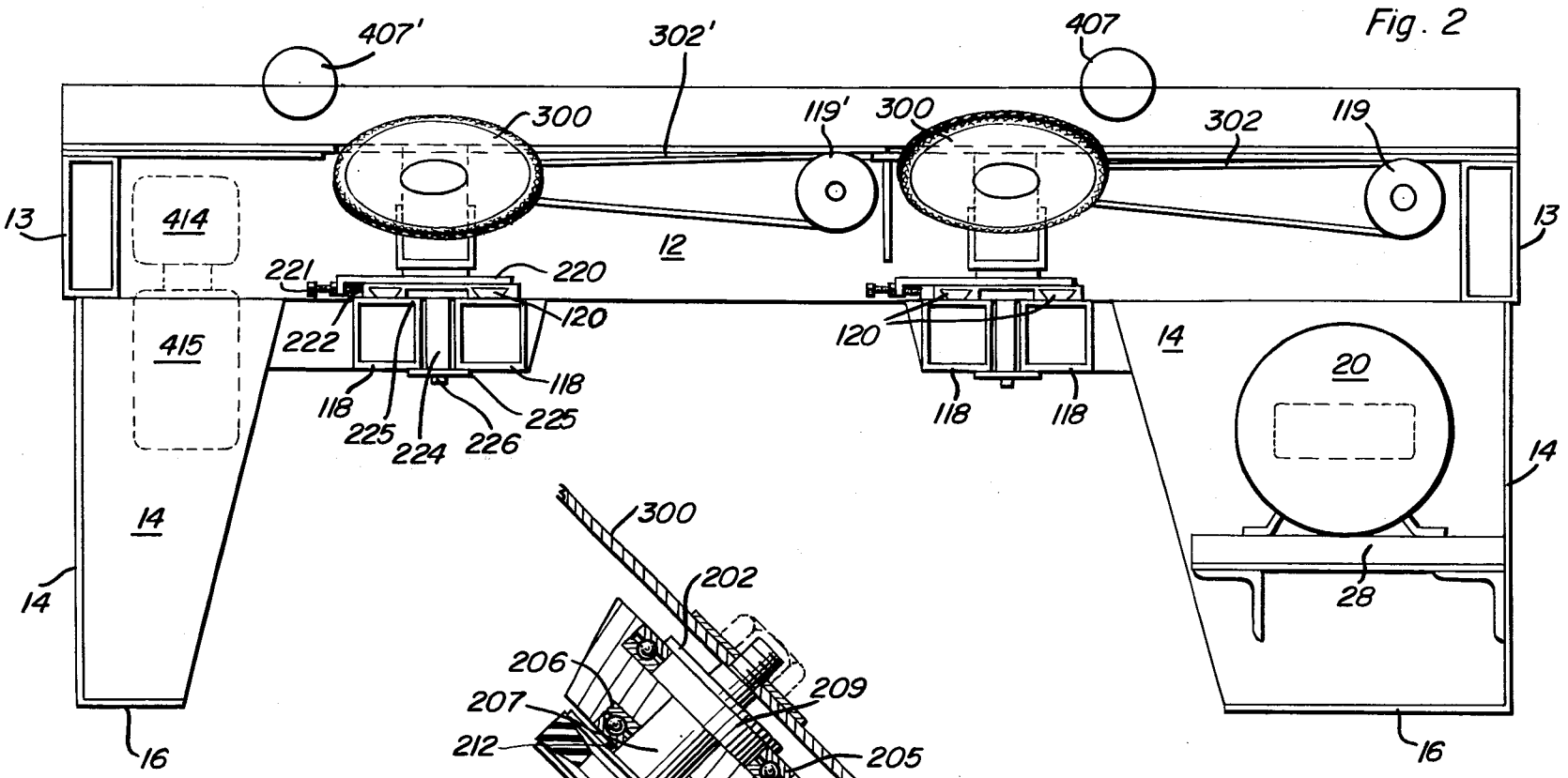
FIG. 2 is a left side view of the machine of this invention.
Figure 3:
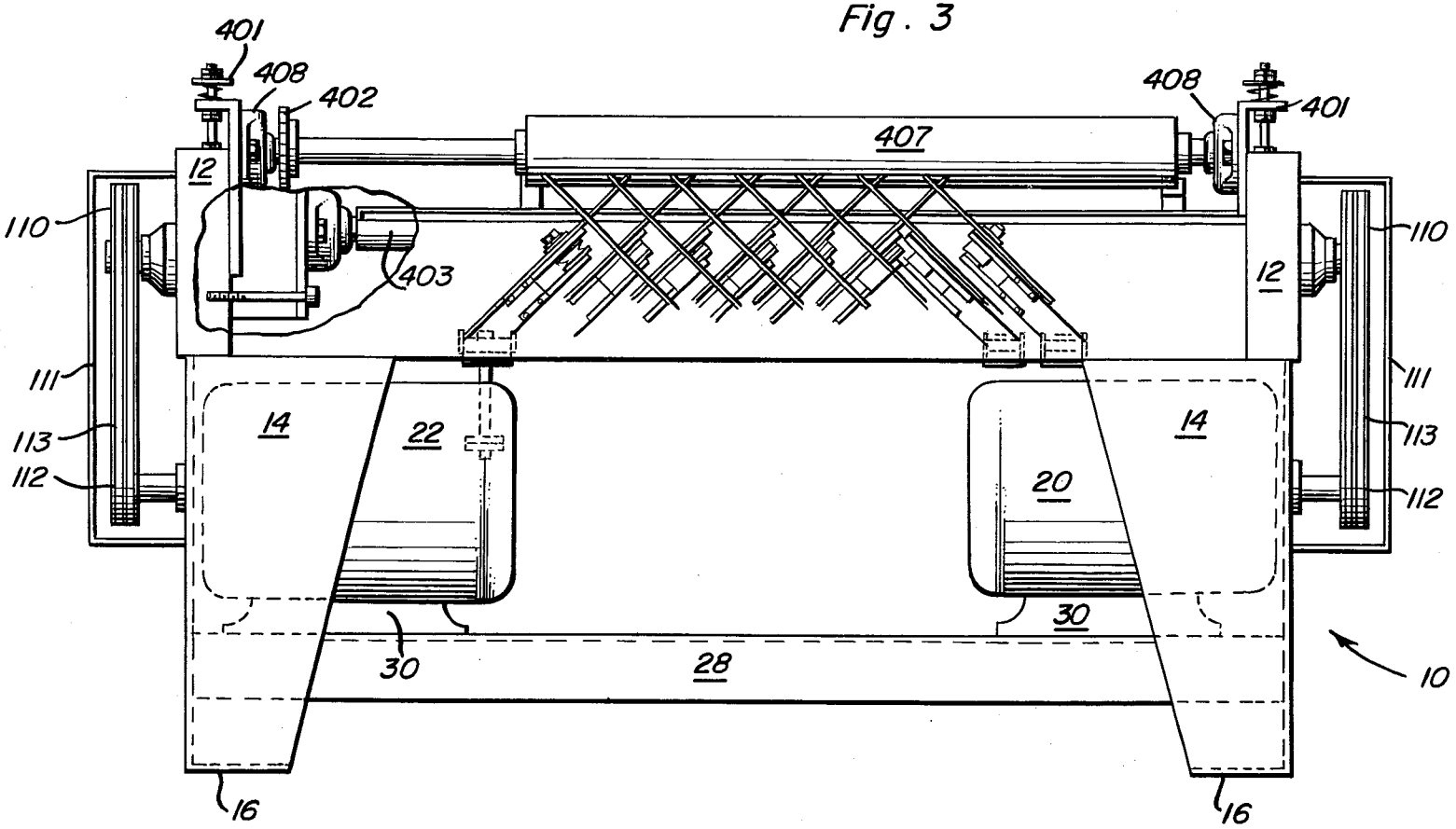
FIG. 3 is a front end view, partly in cross section, of the machine of this invention.

Referring to FIG. 3 of the drawings, reference numeral 10 indicates the over-all cant strip sawing machine of this invention. The main frame for the machine consists of hollow steel tubing sections 12 and 13 normally from cold rolled stock and of approximately 3 inches by 12 inches in cross section and of appropriate size to make an over-all frame of 4 feet 4 inches by 6 feet 10 inches outside dimensions. Where the pieces abut at the corners appropriate welding, not shown, is used to securely fasten the steel tubing together. Beneath the four corners of the main frame structure are welded support legs 14. These support legs 14 consist of two flat, half inch stock, triangular shaped pieces welded at the corners where they abut with two pieces being provided and appropriately welded at each corner of the main frame structure as best seen in FIGS. 1 and 2. An optional bottom plate 16 for said legs may also be provided.

Now viewing FIG. 2, the supports for the saw blade assemblies will be described. Two sets of twin crossbars 118 cut from four inch by four inch steel tubing are set approximately two inches apart to accommodate the bases for the saw arbors. These steel tubes 118 are appropriately welded to the side frame members 12 underneath thereof. Dovetail ways 120 are centered on the top of each of said crossbars and serve as guides for the adjustable saw blade assemblies.

Intermediate drive shafts 21 and 23 are supported from appropriate bearing mounts 24. The intermediate drive shaft 21 is supported approximately the middle of the frame and the intermediate drive shaft 23 is supported adjacent the front of the support table. One end of each of said intermediate drive shafts has a double pulley 110 thereon for transfer of power from a motor-driven pulley 112 by means of V-cog belts, as best seen in FIGS. 1 and 3. Two motors 20, 22 of approximately 15 horsepower apiece are appropriately supported on a supporting crossbar 28 and motor support mounts 30. Obviously appropriate mounting adjustment means are provided for each of said motor mounts to permit proper alignment of the drive pulleys 112 with the belts and upper driven pulleys 110. The V-type cog belts are indicated by reference numeral 113. Appropriate belt cover guards 111 are also provided on each side of the machines to protect the operator and other workers from any contact with the revolving pulleys and belts. This is an important safety feature to meet with OSHA standards.

As viewed in FIG. 1 the intermediate drive shafts 21 and 23 must be completely removed from the machine in order to replace the drive belts for the saw arbor assemblies. However, to reduce the replacement time for worn belts an adequate supply of same may be stored at one end of the intermediate drive shafts for use whenever necessary. This invention also provides for a shortening of said intermediate shafts 21 and 23 so that the bearing 24' on the end of said shaft opposite to the drive pulley 110 may be easily removed by simply removing bolts 25. With the shortened drive shaft 21 terminating just inside of the frame member 12, this end of the drive shaft is raised for replacement of pulleys 119 and the corresponding saw blade drive belts. The corresponding opposite end of intermediate drive shaft 23 may also be so shortened with the bearing block for said end also being readily removable, not shown.

The saw arbors, their special shape and special function are very important features of this machine. The base of the arbors are each individual bases, preferably made from one-half inch thick steel approximately three inches by twelve inches. Centered on the underside of the base, a two inch wide by one-half inch thick steel bar is connected to the base by two 5/16 inch countersunk screws. This bar extends downward approximately 4-¼ inches through the two inch space between the crossbars 118 and is drilled and tapped for an Allen screw (⅜ inch). Another one-half inch thick by four inch steel bar drilled through the center bridges the underside of the crossbars 118. The ⅜ inch Allen screw clamps the one-half inch by four inch steel bar and the connecting bar from the base tightly to the two crossbars 118. Both the clamp and the arbor base are fitted with sliding ways to keep them at a perfect 90° angle to the crossbars.

Figure 4:
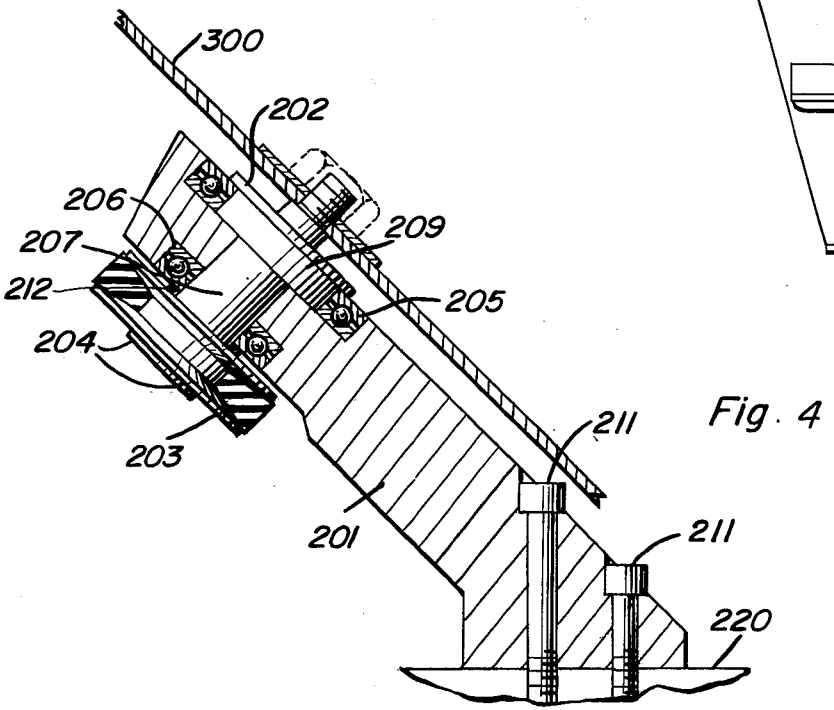
FIG. 4 is a cross-sectional view of one of the saw blade arbor assemblies for use with the machine of this invention.

The arbor saw assembly support structure, best seen in FIG. 4, consists of the following. A solid steel saw assembly bracket 201 is appropriately machined in the shape as shown. Appropriate apertures are bored in the upper end of the member 201 for reception of ball bearings 205 and 206. These bearings preferably are press-fitted into the bracket 201. The saw arbor 202 is then inserted within the bearings, said arbor 202 having an enlarged head portion 209 and a central shaft portion 207. One end of said saw arbor shaft is appropriately machined for reception of a saw blade up to twelve inches in diameter and appropriate locking means such as a locknut shown in broken lines may be used. The other end of arbor 202 has a locking ring 212 and a saw arbor pulley 203 mounted thereon, and locking or fastening screw 204 for said pulley for appropriately fastening the pulley to the shaft for driving purposes.

The other end of the saw arbor support member 201 has appropriate apertures provided therein for reception of short and long socket head type cap screws 211 for the purpose of attaching the saw bracket to adjusting slide 220. Looking at FIG. 2, the adjusting slide 220 can be seen mounted upon the arbor base plate 222 which has complementary dovetail slots therein for slidable movement along the dovetail members 120. The arbor base 222 is adjustably secured to the transverse bars 118 by means 224 and 226. The support means 224 has appropriate clamping plates 225 which engage either side of the bars 118 for clamping thereto by means of the locking screw 226. Thus it can be readily visualized that each individual saw arbor mounted upon the above described structure can be slid sideways or transversely of the over-all machine on the transverse bars 118. Once the desired setting between the individual saw arbor supports is achieved the locking scres 226 for each individual arbor assembly are secured to fasten the saw arbors in place. The base support plate 220 may be adjusted longitudinally of the machine by means of the locking screw and nut thereon 221 for the purpose of increasing or decreasing the individual saw drive belt tensions. The front bank of saw blades are labelled 300 while the secondary or rear bank of saw blades are labelled 300'. Drive belts 302 and 302' are appropriately connected between the driving pulleys 119 and 119' mounted on the intermediate drive shafts 23 and 21. As can best be seen in FIG. 3, all the saw blades 300 are angled to the left as viewed from the front of the machine while all of the secondary saw blades 300' are angled to the right as viewed from the same position. Thus the banks of saw blades are basically perpendicular to each other and are in a respective plane of approximately 45° from the table horizontal plane.

Saw blades up to 12 inches in diameter may be used with this machine. Once the blades are installed on the arbor assemblies and the drive belts properly adjusted for tension and the horizontal spacing between the respective saw blade assemblies adjusted for the desired width of cut, the machine will cut or saw for many hours without any maintenance. Appropriate apertures have been provided in the table surface for passage of the saw blades. Filler plates, not shown, are then installed between the saw blades and the balance of the openings in the table. The tabletop or saw bed is also mounted by adjusting means which will permit a slight adjustment of said table up to an inch or so. Conventional type fences are provided on both the right and left sides of the table bed, to permit adjustment for different widths of material to be cut. The left side normally is the one which is adjustable. Adjustable side tension roller structure 225' is normally provided within the left fence to hold the material being cut against the right side fence.

A self-feeding mechanism is provided for this machine. This consists of the corrugated feed rollers 407 and 407' appropriately mounted on the upper portion of the machine by tension bearing mounts 401. The feed rollers 407 and 407' are preferably corrugated steel rollers for gripping and feeding the material being sawed. The front drive feed roller 407 is provided therebeneath with a lower idler roller 403, best seen in FIG. 3. Ball bearing support assemblies 408 are appropriately provided for the shafts of each of said rollers. A sprocket 402 is provided at one end of the feed roller shaft and appropriately connected by a chain drive 426. The chain drive is appropriately driven from a small electrical motor 415, preferably of approximately 1-½ horsepower which has reduction transmission 414 to reduce the output speed for the purpose of driving the chain and gearings for the feed rollers.

A safety cover, not shown, is appropriately provided for covering the entire top of the machine once all the adjustments have been made and the machine is ready to be put into operation. Appropriate safety switches of the magnetic on-off type together with a reversible feed switch for the feed rollers are all mounted in a switch panel 60 shown in FIG. 1. Appropriate over-load fusing may also be provided within this panel.

Another feature envisioned by this invention is sawdust collection means provided adjacent the saw blade assemblies either on top of the table bed or underneath thereof.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A cant strip sawing machine comprising; means for sawing multiple cant strips for use in the industrial roofing trade simultaneously including a strong support frame, means on said support frame for adjustably mounting two banks of saw blade assemblies, means provided for positively feeding material to be cut lengthwise into said banks of saw blade assemblies for the purpose of producing high speed cutting of a large number of cant strips simultaneously, the means for adjustably mounting the two banks of saw blade assemblies including a plurality of transverse bars across the width of the support frame, with each bank of saw blade assemblies having individual adjustments for each respective blade assembly associated with the transverse bars, and further including intermediate drive shafts appropriately supported on the said support frame together with adjustable means between each individual saw blade assembly and the closest associated intermediate drive shaft for permitting accurate adjustments of the width of cant strips to be cut as well as tension adjustments for the drive means for the saw blades.

2. A cant strip sawing machine comprising; means for sawing multiple cant strips for use in the industrial roofing trade simultaneously including a strong support frame, means on said support frame for adjustably mounting two banks of saw blade assemblies, and means provided for positively feeding material to be cut lengthwise into said banks of saw blade assemblies for the purpose of producing high speed cutting of a large number of cant strips simultaneously, the means for adjustably mounting the two banks of saw blade assemblies including a plurality of transverse bars across the width of the support frame, with each bank of saw blade assemblies having individual adjustments for each respective blade assembly associated with the transverse bars, and the means provided for positively feeding material to be cut including at least a single feed roller mounted transversely of the support frame.

3. The structure as set forth in claim 2, wherein the feed means includes two feed rollers of corrugated steel with one of said feed rollers being in front of the first of the first bank of saw blade assemblies and the second of said feed rollers being at the rear of the second bank of saw blade assemblies.

4. The structure as set forth in claim 3, together with additional tension adjusting means for each feed roller and with the front of said feed rollers including an idler roller associated therewith.

5. The structure as set forth in claim 4, including intermediate drive shafts appropriately supported on the said support frame together with adjustable means between each individual saw blade assembly and the associated intermediate drive shafts for permitting adjustments of the width of cant strips to be cut as well as tension adjustments for the drive means for the saw blades assemblies.

6. The structure as set forth in claim 5, together with safety device means to protect the operator and associated workers from injury being mounted on the support frame.

7. The structure as set forth in claim 6, wherein the safety device means includes a switch panel having magnetic on-and-off switches and a reversing switch for the feed rollers.

8. The structure as set forth in claim 5, including three drive motors, one of said drive motors driving the first bank of saw blade assemblies, the second of said drive motors driving the second bank of saw blade assemblies, and the third drive motor connected for driving the feed rollers.

9. The structure as set forth in claim 8, wherein the driving connection between the first two drive motors and their respective banks of saw blade assemblies comprise belt and pulley connecting means.

10. The structure as set forth in claim 9, wherein the drive connection between the third drive motor and the feed rollers includes a chain and sprocket type drive connection structure.

11. The structure as set forth in claim 10, wherein the first bank of saw blade assemblies include saw blades in a plane 45 degrees from the horizontal, and the second bank of saw blade assemblies include saw blades in a plane at an angle 45 degrees from the horizontal but opposite in orientation to the first bank of saw blades so the respective planes of the saw blade assemblies are perpendicular to each other.

12. The structure as set forth in claim 5, wherein the first bank of saw blade assemblies include saw blades in a plane 45 degrees from the horizontal, and the second bank of saw blade assemblies include saw blades in a plane at an angle 45 degrees from the horizontal but opposite in orientation to the first bank of saw blades so the respective planes of the saw blade assemblies are perpendicular to each other.

13. The structure as set forth in claim 12, including safety covers over the respective said drive connections for the protection of the operator of the machine and associated workers.

* * * * *